US005797340A

United States Patent [19]

Peeters

[11] Patent Number: 5,797,340

[45] Date of Patent: Aug. 25, 1998

[54] ANCHOR RETRIEVAL SYSTEM AND DEVICE

[76] Inventor: William Henry Peeters, 68 Mayers Drive, Tuncurry, New South Wales 2428, Australia

[21] Appl. No.: 795,977

[22] Filed: Feb. 5, 1997

[30] Foreign Application Priority Data

Feb. 5, 1996 [AU] Australia ..... PN7899

[51] Int. Cl.[6] ..... B63B 21/24

[52] U.S. Cl. ..... 114/221 R; 114/297

[58] Field of Search ..... 114/297, 299, 114/51, 221 R

[56] References Cited

U.S. PATENT DOCUMENTS 4,552,087 11/1985 Van Oene ..... 114/297

5,666,899 9/1997 Anderson ..... 114/297

*Primary Examiner*—Ed L. Swinehart

*Attorney, Agent, or Firm*—Ladas & Parry

[57] ABSTRACT

An anchor retrieval system comprising a buoy (20) from which there depends an anchor retrieval device (40) comprising an aperture through which an anchor chain or rope or the like can pass, which anchor chain or rope or the like has one end attached to a vessel (11) and the other end attached to an anchor (14).

19 Claims, 4 Drawing Sheets

ANCHOR RETRIEVAL SYSTEM AND DEVICE

FIELD OF THE INVENTION

The invention relates generally to the field of retrieving boat anchors, and more particularly, to an anchor retrieval system and device for retrieving anchors which are attached to a boat with a rope or chain configuration.

BACKGROUND OF THE INVENTION

Boats and other marine vessels are typically equipped with an anchor which is cast out when the vessel is to remain stationary, and which is then retrieved when the vessel is to move to another location. Anchors are typically attached to a length of chain, i.e., connecting chain, which is then attached to an anchor line, e.g., rope, connected to the boat. In the past, anchors have been retrieved by hand which required strenuous effort to dislodge the anchor from the water's bottom and then pull up the anchor.

More recently, a device shaped like a hook or a V has been used to retrieve anchors. Such a device includes a spring peg at the top of the hook or V, and is attached to a buoy. In operation, the spring peg is pulled open to allow insertion of the anchor line through the hook or V. The device, along with the buoy, is then placed overboard whereafter the vessel travels a distance thereby pulling on the anchor line. As the vessel travels, it is intended that the anchor line travel through the hook or V so that the anchor is pulled upwards. It is also intended that when the anchor reaches the surface of the water, the anchor line, the connecting chain and the anchor itself be pulled into the vessel, typically by hand.

The foregoing arrangement has several shortcomings however. First, it oftentimes does not operate as intended. This is because the hook or V shape of the device does not provide sufficient spacing for the anchor line to smoothly travel therethrough. For example, knots or splices in the anchor line frequently bind up in the device thereby requiring untangling by hand. Furthermore, the narrow spacing provided by the hook or V often leads to the anchor line being constricted even in the absence of knots or splices.

Second, regardless of the anchor line binding up in the device, the device typically does not allow the connecting chain to pass through because once again, the lack of leeway binds on the anchor line/connection chain interface or binds on the connection chain itself. Thus, even where the anchor line has successfully travelled through the device, the connection chain and anchor are left dangling in the water. Accordingly, when retrieving the anchor into the vessel, the operator must lift the full weight of the chain and anchor.

Third, such devices must typically be replaced at least because of wearing or rusting of the spring clip. That is, the spring clip is typically made from spring steel which will rust over time. Furthermore, the spring clip has only so much resilience before its elasticity is lost and plastic deformation or other weakening occurs. Any of the foregoing requires replacement of the device which is costly and inconvenient.

It is the object of the present invention to overcome or substantially ameliorate the above disadvantages.

SUMMARY OF THE INVENTION

The invention in one broad form provides an anchor retrieval system comprising a buoy from which there depends an anchor retrieval device comprising an aperture through which an anchor chain and/or rope or the like can pass, which anchor chain or rope or the like in use has one end attached to a vessel and the other end attached to an anchor. It is preferred that a shackle be used to connect the buoy and retrieval device. It is preferred that the components of the system are rustproof. It is preferred that the retrieval device comprise stainless steel. It is preferred that the anchor retrieval system allow an anchor line and connecting chain to pass through the retrieval device so that the anchor engages the retrieval device upon reeling in the anchor. It is preferred that the shackle comprise a D shackle. It is preferred that the buoy exhibit a buoyant force large enough to support the anchor line, connecting chain and anchor.

Preferably, said retrieval device comprises a connecting ring adapted to engage with a shackle or the like for securing the retrieval device to the buoy, the retrieval device further comprising an anchor line ring depending from the connecting ring and having a neck situated therebetween, the anchor line ring terminating with a stem which is situated alongside said neck and retained in close proximity thereto by means of a locking ring. It is preferred that the end of the stem is angled outward. It is preferred that the neck and stem are biased away from each other. It is preferred that the anchor line ring be configured to allow the anchor line, connecting chain and anchor stem to pass through. It is preferred that the anchor line ring permit knots and splices to pass through. It is preferred that the anchor retrieval device include a saddle mounted on the anchor line ring which prevents the lock ring from falling down onto the anchor line ring. It is preferred that the connection ring be adapted to attach to a shackle and/or buoy. It is preferred that the neck, anchor line ring and stem be formed from one contiguous rod of stainless steel.

BRIEF DESCRIPTION OF THE FIGURES

A preferred form of the present invention will now be described by way of example with reference to the accompanying drawings, wherein.

DESCRIPTION OF THE PREFERRED EMBODIMENTS

Figure 1:
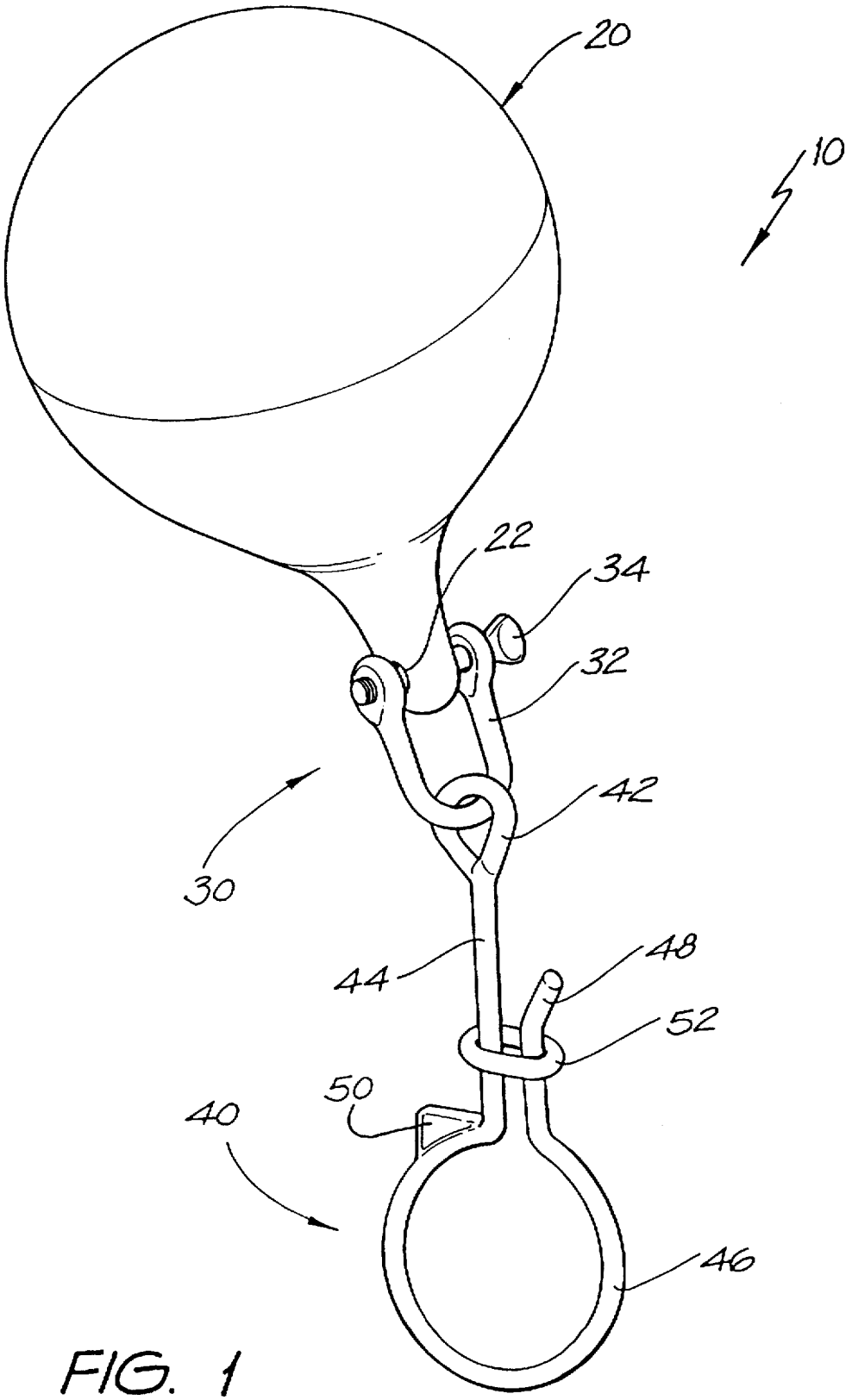
FIG. 1 is an anchor retrieval system.

Referring now to FIG. 1, an anchor retrieval system 10 includes buoy 20 which can be attached to shackle 30; which can in turn be attached to anchor retrieval device 40. As discussed in more detail later, system 10 operates by inserting the anchor line (not shown in FIG. 1) through device 40. While buoy 20 floats upon the water, the vessel travels a distance such that the anchor line and connection chain travel through device 40 thereby lifting We anchor to the water surface for retrieval into the vessel.

Buoy 20 preferably includes eyelet 22 to which shackle 30 can be connected. Buoy 20 can comprise any standard type of buoy such as a styrene foam float. Alternatively, buoy 20 can comprise a drum with a handle which serves as eyelet 22. For example, a 20–25 litre plastic drum, a kerosene drum or other type of drum can be used. Furthermore, combinations of the foregoing types of buoys can be used, e.g., multiple styrene foam floats. In any event it is preferred that whatever type of buoy(s) is used, it exhibits a buoyant force sufficient to support the anchor, connection chain and anchor line.

Shackle 30 can be formed of stainless steel to avoid rusting, and can comprise a D shackle as shown. Alternatively, shackle 30 can comprise a rope or some other attachment means. Shackle 30 can comprise flange 32 which accommodates pin 34 that extends through eyelet 22.

Figure 2:
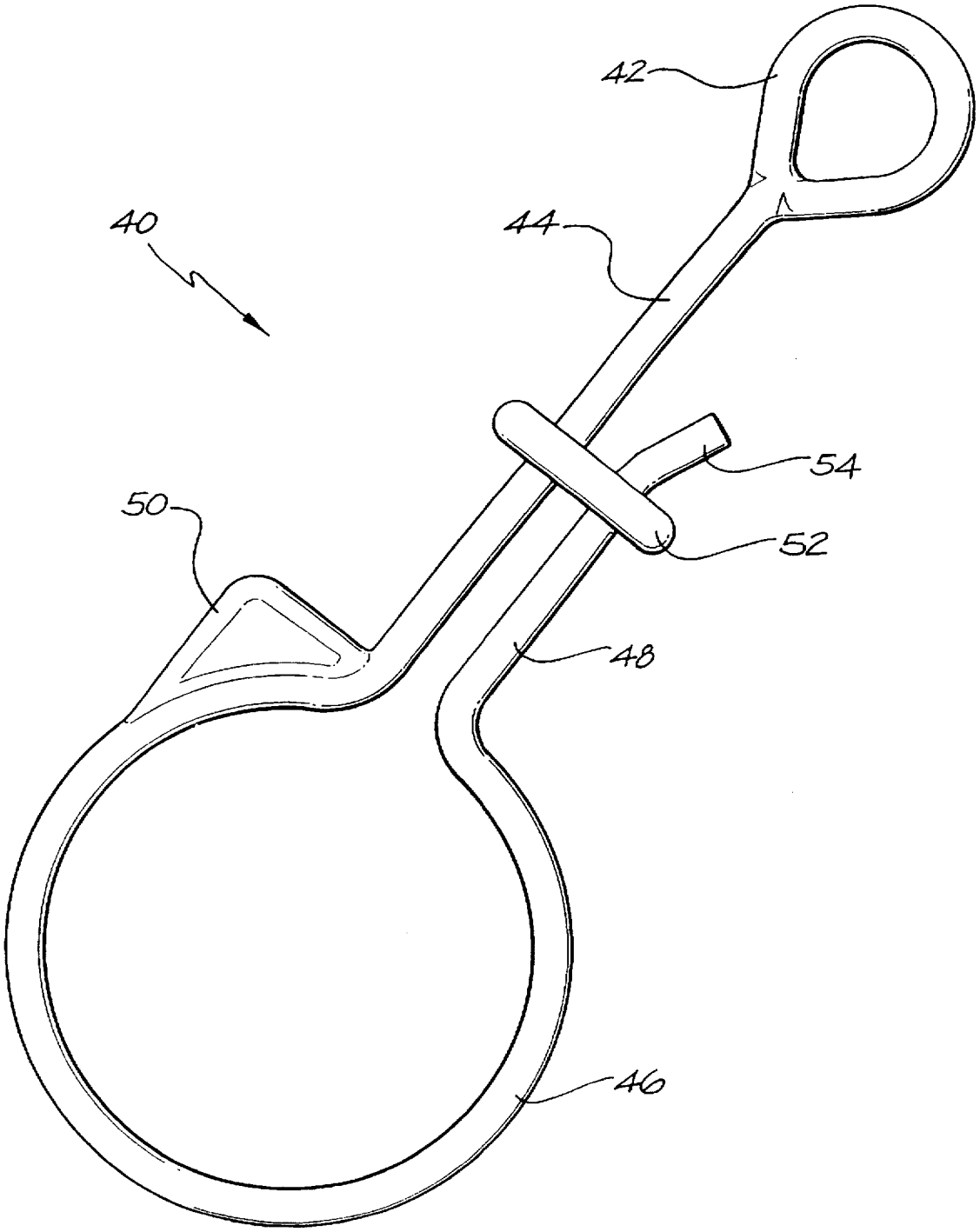
FIG. 2 is an anchor retrieval device.

Device 40, shown in more detail in FIG. 2, preferably comprises stainless steel to avoid rusting. To this end, stainless steel 316 grade, i.e., marine grade, can be used but other grades can be used as well. Device 40 can attach to shackle 30 via connection ring 42 which can be welded or otherwise attached to neck 44. Neck 44 extends to anchor line ring 46 which curves around to stem 48. Neck 44, anchor line ring 46 and stem 48 can be formed from a contiguous stainless steel rod which can be bent as shown. Saddle 50 can be welded or otherwise attached to anchor line ring 46, and lock ring 52 generally encompasses neck 42 and stem 48 as shown and can slide therealong. The foregoing components of device 40 can be formed from stainless steel rod bar having a diameter of about 9 mm to 10 mm but other diameter rods can be used.

Connection ring 42 can have an inside diameter of about 35 mm but other diameters which accommodate the thickness of shackle 30, rope or other means to attach device 40 to buoy 20 can be used. It is preferred that connection ring 42 can freely move about shackle 30 and to this end, connection ring 42 can be circular but elliptical and other shapes can be used.

Neck 44 can have a length of about 140 mm but other lengths can be used. Anchor line ring 46 preferably has a diameter large enough so that typical anchor line ropes, as well as connecting chains can freely pass through. To this end, ring 46 can have an inside diameter of about 115 mm. Other diameters can be used provided that they accommodate standard marine anchor lines and connecting chains. Stem 48 can have a length of about 70 mm with an angled end region by that can be about 25 mm long. Other lengths can be used but it is preferred that stem 48 not extend too closely to connection ring 42 to avoid hampering the operation of lock ring 52 as described below.

In operation, neck 44 and stem 48 are squeezed together so that lock ring 52 can be slid over the angled end 54 of stem 48 and towards connection ring 42. To this end, the rod bar comprising device 40 is formed so that stem 48 is biased away from neck 44, but the bar is still thin enough to allow such squeezing. End 54 is angled outward to an extent that still permits lock ring 52 to slide thereover after device 40 has been squeezed. Lock ring 52 can have an inside diameter of about 40 mm but other diameters can be used depending on the amount of angle of end 54. Lock ring can be circular or elliptical or of some other suitable configuration.

After lock ring 52 is out of the way, the anchor line can then be slid between neck 44 and stem 48 and into anchor line ring 46. Thereafter, neck 44 and stem 48 can be squeezed so that lock ring 52 can be slid over angled end 54. Because stem 48 is biased as mentioned above, neck 44 and stem 48 preferably exert an outward force against lock ring 52 so that lock ring 52 cannot easily slip over angled end 54. The anchor line is thus securely within device 40 and lock ring 52 is generally prevented from coming undone by angled end 54.

Saddle 50 serves to avoid lock ring 52, from becoming fully disengaged from device 40. That is, when device 40 is lying in the boat before being used, lock ring 52 can be positioned so that it is around only neck 44 and not also stem 48. When so configured, if device 40 is picked up or moved, lock ring 52 might then fall down into the area of anchor line ring 46. With subsequent movement of device 40, lock ring 52 might then continue towards stem 48 and fall off angled end 54. Saddle 50 prevents this occurrence so that when device 40 is to be used, the operator need not waste time looking for a dislodged lock ring 52. To this end, saddle 50 can be configured in any dimension as long as it prevents lock ring 52 from sliding down neck 44 onto anchor line ring 46.

Figure 3A:
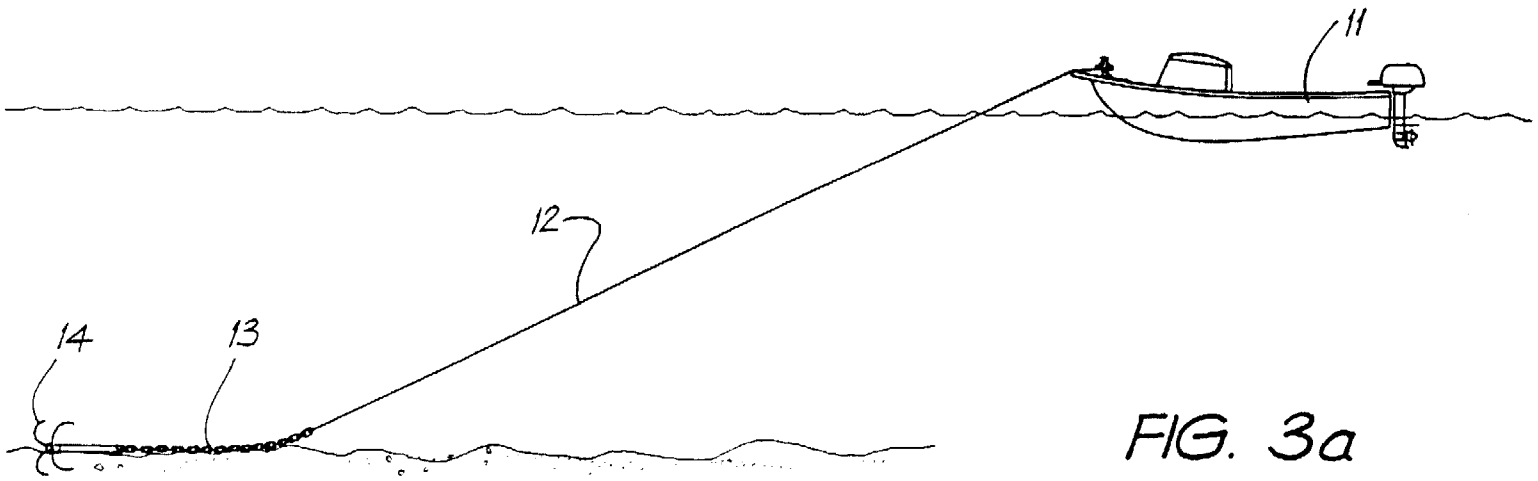
FIG. 3*a* shows a boat at an anchored position.
Figure 3B:
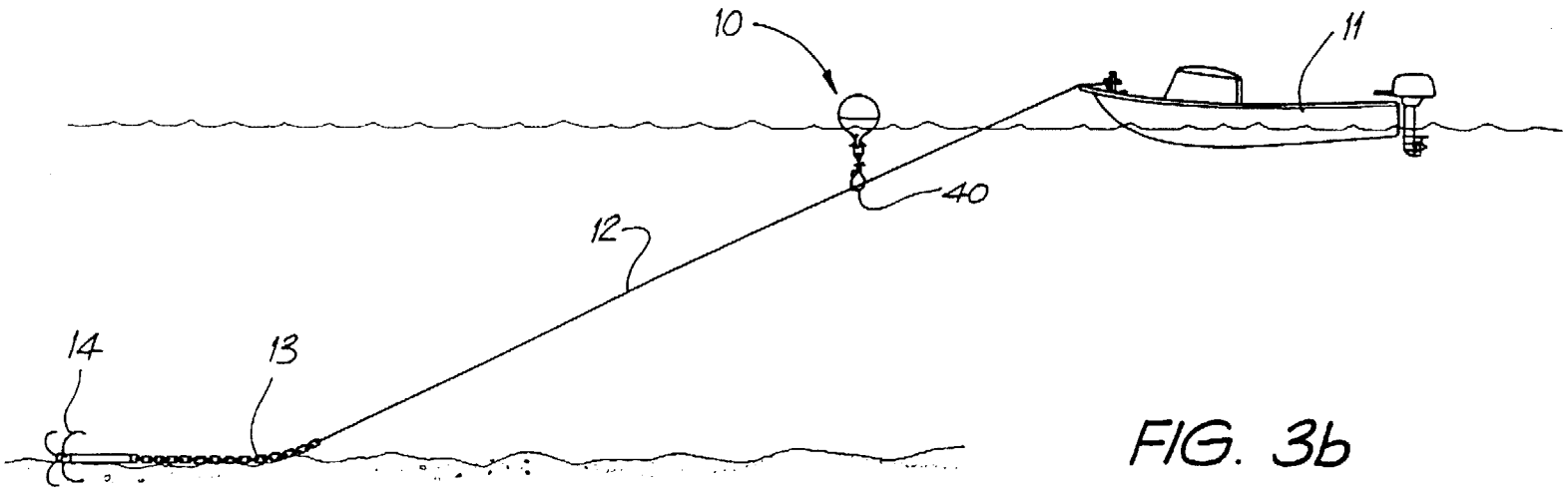
FIG. 3*b* shows the boat of FIG. 3*a* with an anchor retrieval device installed on the anchor line and the anchor retrieval system in place for retrieving an anchor.

Reference is now made to FIGS. 3*a*–3*d* which show device 40 and anchor retrieval system 10 in operation. As shown, boat 11 is anchored by anchor line 12 which extends down to connection chain 13 and anchor 14. FIG. 3*b* shows anchor retrieval system 10 in place after anchor line 12 has been placed through anchor line ring 46 as described above.

Figure 3C:
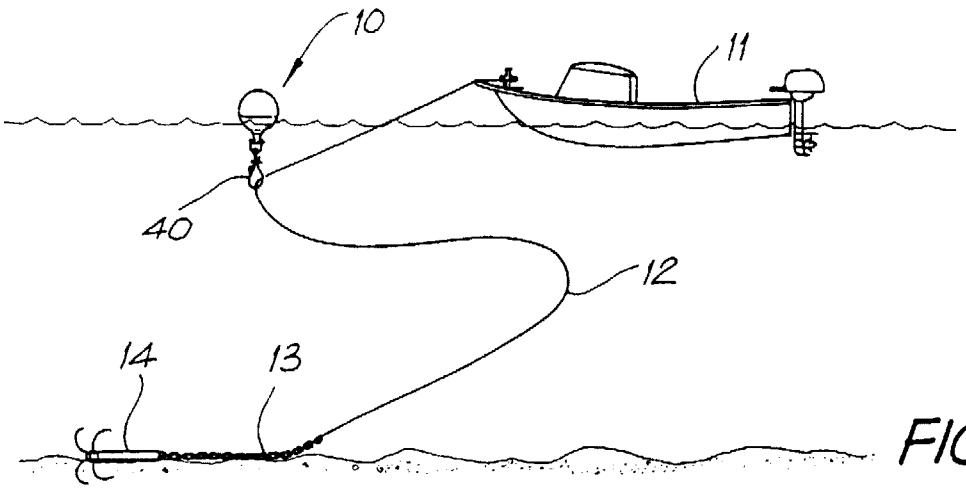
FIG. 3*c* shows the boat of FIG. 3*a* after having travelled a distance.

To begin retrieval of anchor 14, boat 11 can be driven forward as shown in FIG. 3*c* to the left or right of anchor line 12 but parallel to the lie of anchor line 14. To this end, boat 11 can be driven about 5 m to the left or right though this distance is not required. It is preferred that boat 11 not be driven straight over anchor line 12 so that it does not become tangled or severed by the propeller. However, it should be noted that buoy 20 typically maintains a distance between anchor line 12 and boat 11.

As shown in FIG. 3*c*, buoy 20 is at this point generally positioned over anchor 14.

Figure 3D:
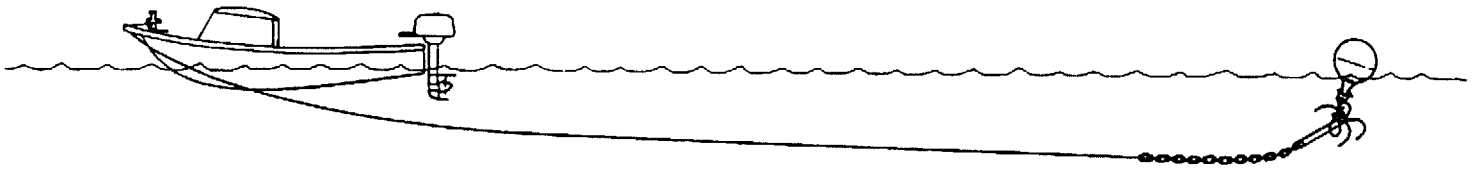
FIG. 3*d* shows the boat of FIG. 3*a* after having travelled a further distance so that the anchor line and connection chain have fully passed through the anchor retrieval device and so that the anchor is supported by the device.

As shown in FIG. 3*d*, as boat 11 continues to move forward, slack in anchor line 12 is taken up so that anchor line 12 becomes taught. Because anchor line 12 does not bind up on ring 46, it easily slides through and as a result, device 10 is not extensively dragged by the boat and anchor line 12 is drawn up somewhat vertically. Accordingly, anchor 14 generally tilts from its lodged position as shown in FIG. 3*a*–3*c* to a position where it is generally pointing upwards.

Boat 11 then continues to move forward so that the full length of anchor line 12 passes through anchor line ring 46 as does the fall length of connecting chain 13. The stem of anchor 14 can also pass through ring 46 so that anchor 14 engages device 40 and is supported by buoy 20. And as mentioned above, it is preferred that buoy 20 exhibit a buoyant force sufficient to support anchor line 12, connecting chain 13 and anchor 14. The anchor line 12 and thus anchor 14 can then be reeled in by hand or by a winch or other mechanised means.

The anchor retrieval system 10 and device 40 of the invention provide at least the following benefits. First, device 40 is suitable for use on generally all approved anchor line rope types and thicknesses and as mentioned above, can accommodate knots, splices, the anchor line/connecting chain interface as well as the connecting chain and anchor stem. This represents an advance over existing systems which can typically bind on the anchor line and/or connecting chain. Furthermore, system 10 and device 40 can be used with various types of anchors including reef picks as well as sand, secure, admiralty and danforth anchors, and can also be used with various sized boats including those from 3 m to 10 m.

Second, because connecting chain 13 and the stem of anchor 14 can pass through ring 46, the weight of connecting chain 13 and anchor 14 are supported by system 10 which eases the lifting of chain 13 and anchor 14 into the boat. In contrast, existing systems typically do not allow the connecting chain to pass through the retrieval system. Consequently, the chain and anchor are still dangling in the water after the anchor line has been retrieved, and their full weight must be lifted when pulling them into the boat. With the current invention however, anchor 14 engages device 40 and is supported by buoy 20. Accordingly, chain 13 can be lifted into the boat without having to also lift up anchor 14 at the same time. After chain 13 is reeled in, anchor 14 can then be lifted into the boat.

Third, the components of system 10 are rustproof and do not undergo repeated bending motion which leads to long life and little if any replacement costs. This is an advance over existing systems which include a spring steel clip that rusts and/or weakens over time thereby requiring replacement.

Thus a novel anchor retrieval system and retrieval device have been described by the foregoing. However, it is to be understood that the invention is not restricted to the foregoing described and illustrated embodiments. Rather, the invention encompasses all modifications and variations that would be apparent to one skilled in the art.

What I claim is:

1. An anchor retrieval system comprising a buoy from which their depends an anchor retrieval device comprising an aperture through which an anchor chain and/or rope can pass, which anchor chain or rope in use has one end attached to a vessel and the other end attached to an anchor wherein said retrieval device comprises a connecting ring adapted for securing the retrieval device to the buoy, the retrieval device further comprising an anchor line ring depending from the connecting ring and having a neck situated therebetween, the anchor line ring terminating with a stem which is situated alongside said neck and retained in close proximity thereto by means of a locking ring.

2. The retrieval system of claim 1 further comprising a shackle connecting the buoy to the retrieval device.

3. The anchor retrieval system of claim 1 comprising rust proof components.

4. The anchor retrieval system of claim 3, wherein said components comprise stainless steel.

5. The anchor retrieval system of claim 2, wherein said shackle is a D shackle.

6. The anchor retrieval device of claim 1, wherein the buoy exhibits a buoyant force in water large enough to support the anchor chain and/or rope and an anchor.

7. The anchor retrieval system of claim 1, wherein an end of the stem is angled outwardly with respect to the neck.

8. The anchor retrieval system of claim 7, wherein the neck and stem are biased away from one another by resilience of the anchor line ring.

9. The anchor retrieval system of claim 1, further comprising a saddle mounted to the anchor line ring which prevents the lock ring from falling down onto the anchor line ring.

10. An anchor retrieval device comprising:

a connecting ring securable to a floatation device;

an anchor line ring having a neck depending from said connecting ring and terminating with a stem situated alongside said neck, said anchor line ring forming an aperture through which an anchor line can pass and have one end attached to a vessel and the other end attached to an anchor; and a locking ring capable of retaining said stem in proximity to said neck.

11. The anchor retrieval device according to claim 10, wherein said floatation device is a buoy.

12. The anchor retrieval device according to claim 10, wherein said anchor line comprises one of a chain, rope and combination thereof.

13. The anchor retrieval device according to claim 10, further comprising a shackle connectable between said connecting ring and said floatation device.

14. The anchor retrieval device according to claim 10, wherein said connecting ring, anchor line ring and locking ring are of a rustproof material.

15. The anchor retrieval device according to claim 14, wherein said rustproof material comprises stainless steel.

16. The anchor retrieval device according to claim 13, wherein said shackle is a D shackle.

17. The anchor retrieval device according to claim 10, wherein an end of said stem is angled outwardly with respect to said neck.

18. The anchor retrieval device according to claim 10, wherein said neck and stem are biased apart from one another by resilience of said anchor line ring.

19. The anchor retrieval device according to claim 10, further comprises a saddle mounted to said anchor line ring and capable of preventing said locking ring from falling down onto said anchor line ring.

* * * * *